US011655621B2

(12) United States Patent
McLeod

(10) Patent No.: US 11,655,621 B2
(45) Date of Patent: May 23, 2023

(54) FLAT DRAIN FOR SHOWERS

(71) Applicant: Christopher Adam McLeod, Toronto (CA)

(72) Inventor: Christopher Adam McLeod, Toronto (CA)

( * ) Notice: Subject to any disclaimer, the term of this patent is extended or adjusted under 35 U.S.C. 154(b) by 203 days.

(21) Appl. No.: 17/372,617

(22) Filed: Jul. 12, 2021

(65) Prior Publication Data

US 2023/0008625 A1 Jan. 12, 2023

(51) Int. Cl.
*E03C 1/12* (2006.01)
*E03F 5/04* (2006.01)

(52) U.S. Cl.
CPC ..... *E03C 1/12* (2013.01); *E03F 5/0408* (2013.01); *E03F 5/0409* (2013.01)

(58) Field of Classification Search
CPC ..... E03C 1/12; E03F 5/0408; E03F 5/0409
USPC ..... 4/613, 679
See application file for complete search history.

(56) References Cited

U.S. PATENT DOCUMENTS

2020/0291628 A1* 9/2020 Meyers ..... E03C 1/12

FOREIGN PATENT DOCUMENTS

EP 3540138 A1 * 9/2019 ..... E03F 5/0408
WO WO-2017023178 A1 * 2/2017 ..... E03F 5/0409

* cited by examiner

*Primary Examiner* — Tuan N Nguyen

(57) ABSTRACT

A flat shower is a drainage fitting for the evacuation of surface and weeping water arising from showering on a tiled surface, where the tiling installation method is thinset, that is, where the tiles are adhered directly to membrane placed on top of a sloping medium such as mortar or foam installed directly to the subfloor. The height of such tile installations being minimal, a novel, minimal height flat drain assembly comprised of angle bar at the shower wall or flat bar in the midst of the flat tile floor, and said bar(s) then made contiguous with a floor drain membrane, is described.

3 Claims, 11 Drawing Sheets

Isometric view of angle bars fitted to subfloor.

Isometric view of linear drain end caps fitted.

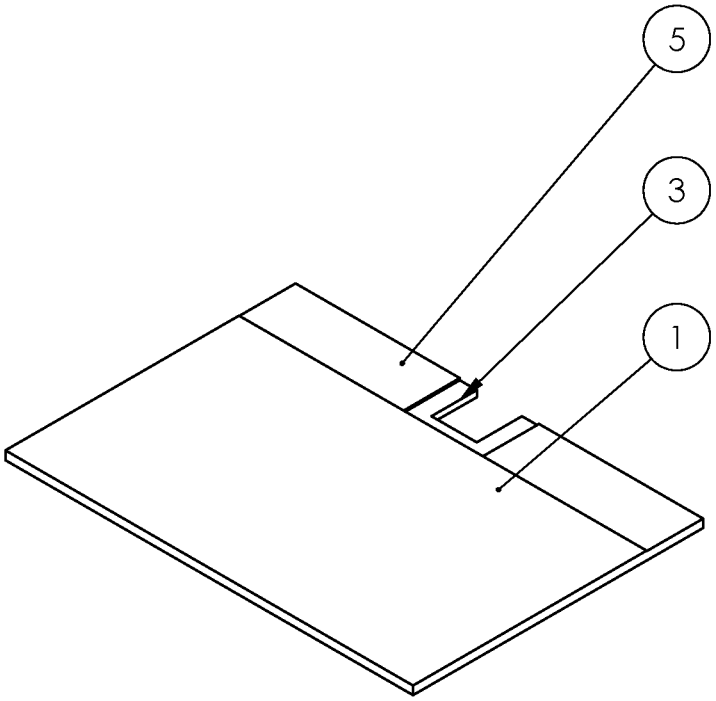
Fig. 1. Isometric view of shower room subfloor

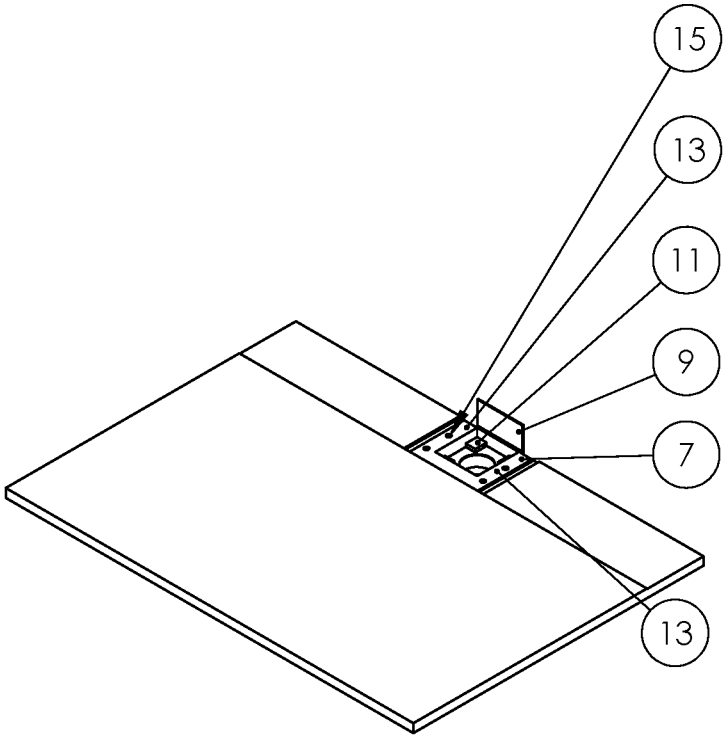
Fig. 2. Isometric view of drain base fitted to subfloor.

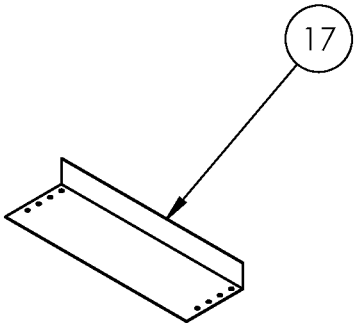
Fig. 3. Isometric view of angle bar.

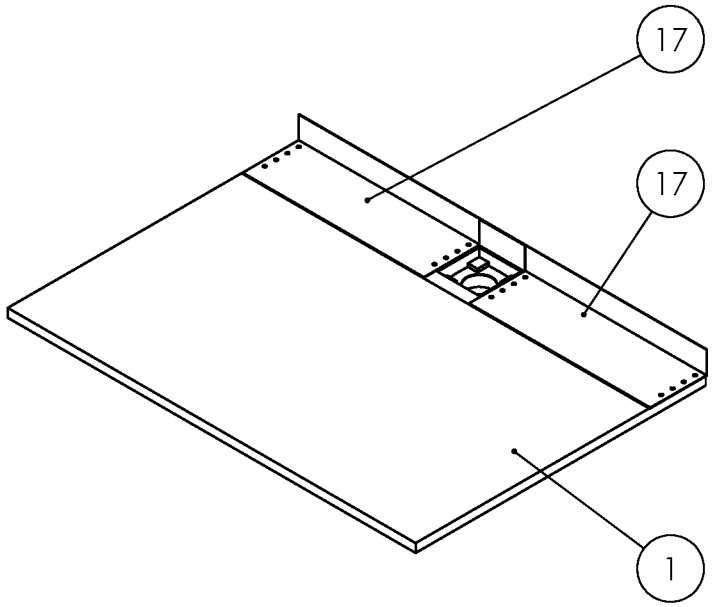
Fig. 4. Isometric view of angle bars fitted to subfloor.

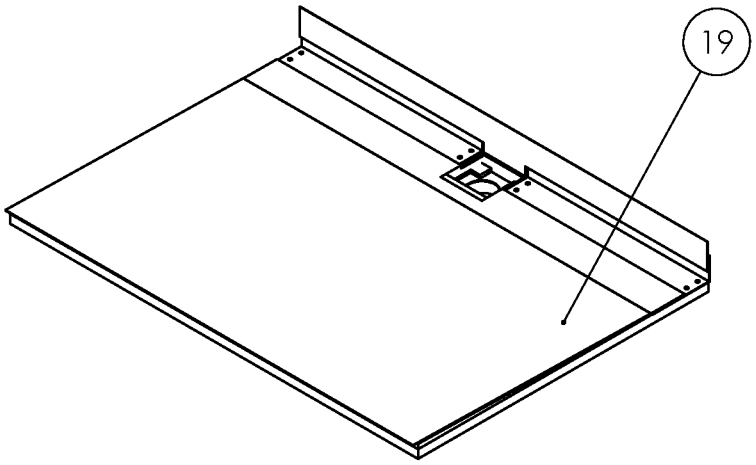
Fig. 5. Isometric view of slope applied.

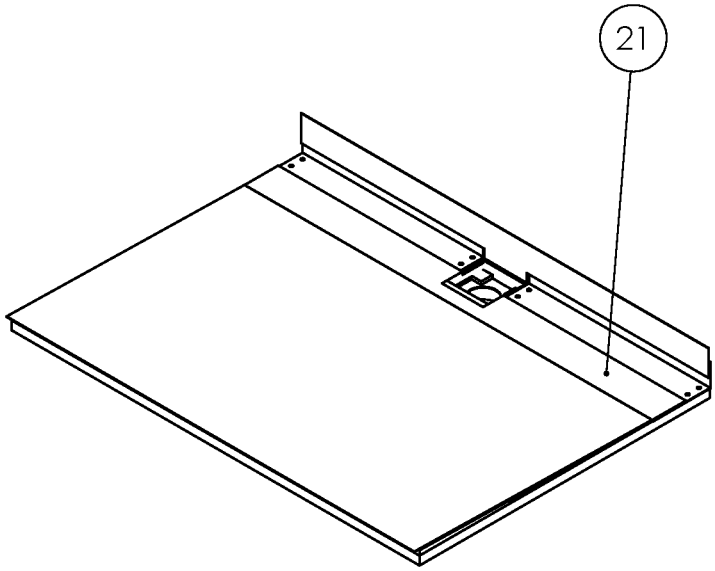
Fig. 6. Isometric view of membrane attached.

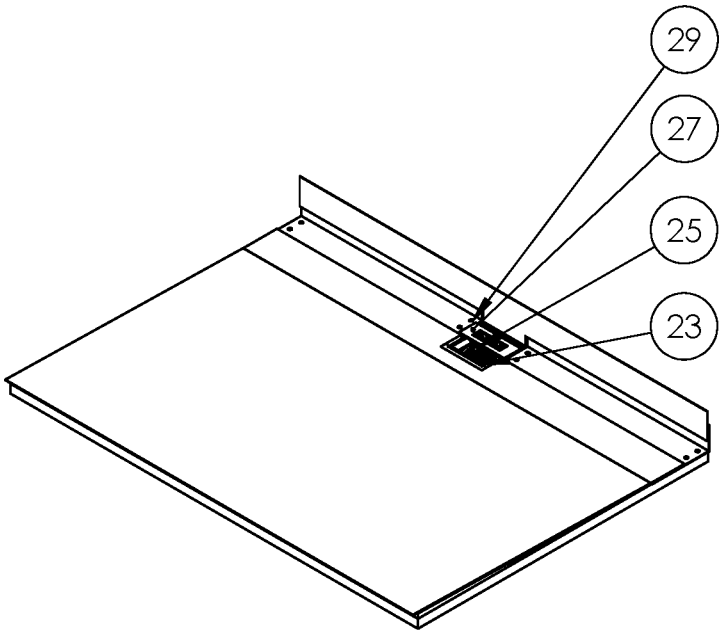
Fig. 7. Isometric view of drain superstructure inserted.

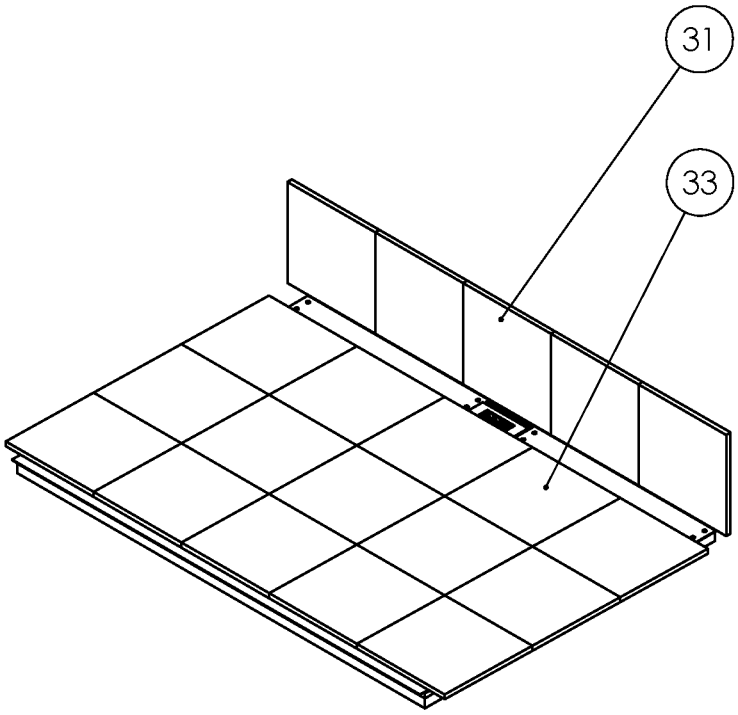
Fig. 8. Isometric view of tiles applied to floor and wall.

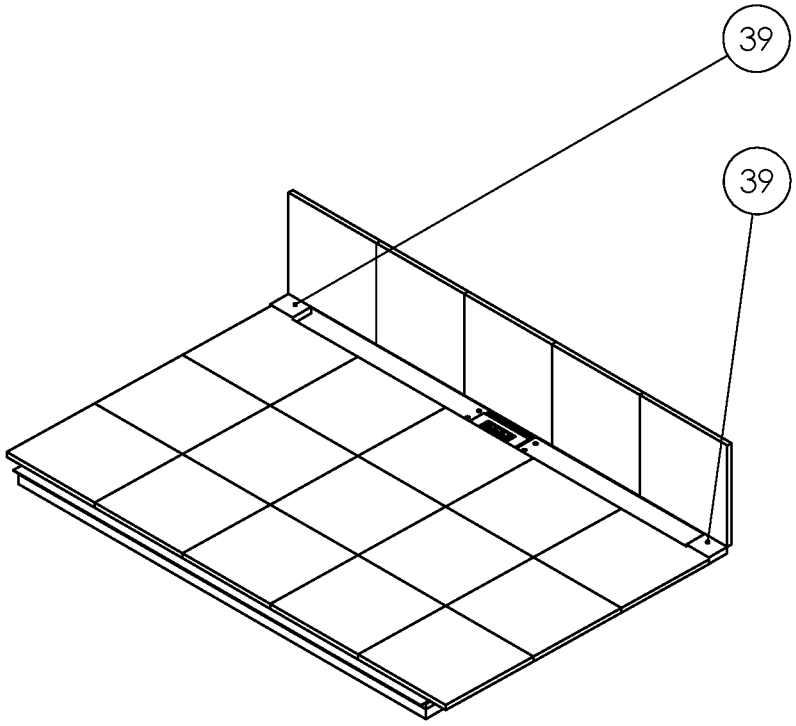
Fig. 9. Isometric view of linear drain end caps fitted.

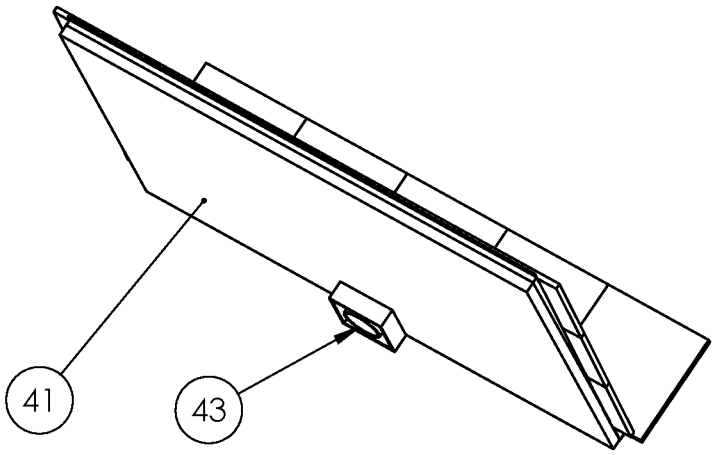
Fig. 10. Isometric view from underneath subfloor.

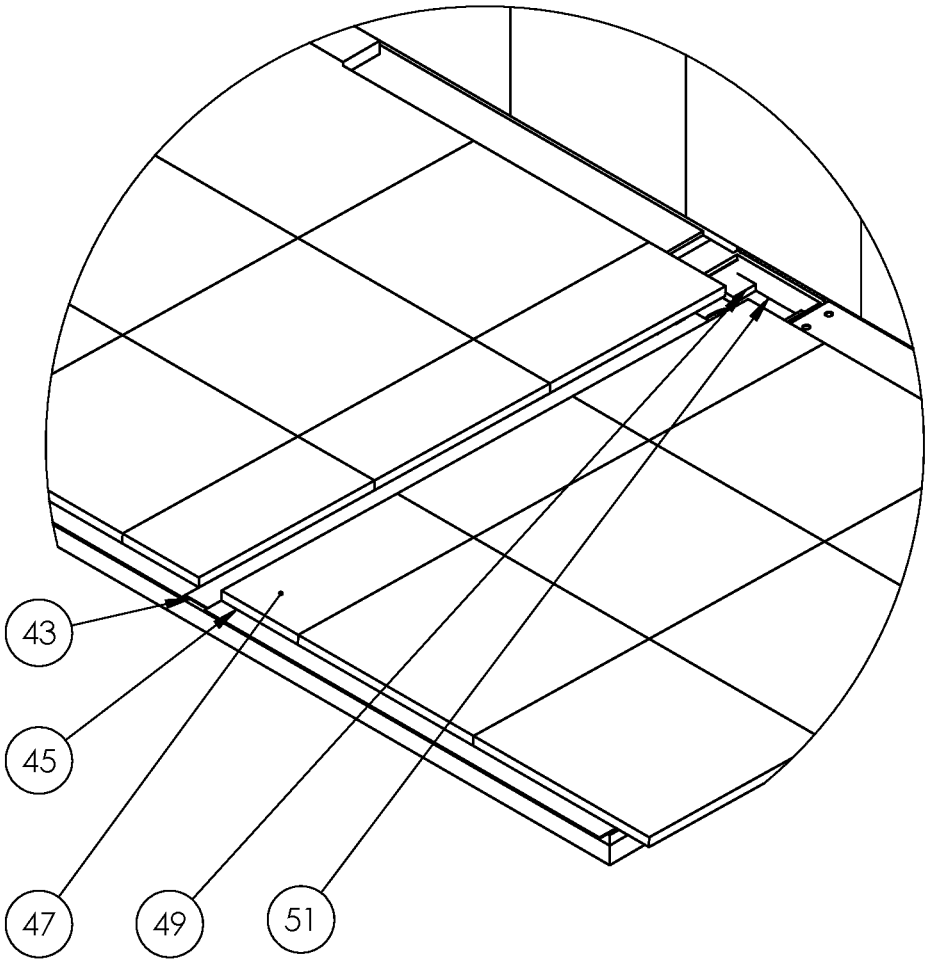
Fig. 11. Isometric detail of flat bar linear drain.

FLAT DRAIN FOR SHOWERS

CROSS-REFERENCE TO RELATED APPLICATIONS

No cross reference is made to other applications.

STATEMENT REGARDING FEDERALLY SPONSORED RESEARCH OF DEVELOPMENT

No Federal Government support was received in the development of this Invention.

SEQUENCE LISTING, TABLE, OR COMPUTER PROGRAM LISTING

No sequence listing, table, or computer program is attached or accompanies this Application.

FIELD OF THE INVENTION

This Invention relates generally to shower drain fittings, and more particularly to shower drains designed to be fitted to thinset tile installations in wetrooms.

BACKGROUND OF THE INVENTION

A drain in a shower room that is wet and requiring drainage of surface water has hitherto often been a point floor drain consisting of a drainage hole, an underlying hub for pipe connecting to a sanitary drain, and an overall drain superstructure to connect the drainage hole with the hub and mount the drain in the floor of the wetroom. Point refers to the lack of any planar extension, such as linear or polygonal. Modern shower rooms have evolved into wetrooms, and the point drain leading to a trap is increasingly replaced by a linear floor drain along the wall, an edge drain, comprising a tray with either a grate fitting on top of a tray, or a tray supporting a structure that allows attachment of tile by a plurality of means.

The wetroom itself has evolved. An early iteration comprises at least a waterproof membrane overlain by a thick layer of sloped mortar surmounted by at least a layer of tiles adhered to the mortar. This is called full mortar tiling. Full mortar tiling differs from another tiling method named thinset tiling in many ways, thinset tiling being the overlay of the subfloor by a thin layer of sloped mortar or pre-shaped foam, a membrane then applied on top of the mortar, and then the membrane being surmounted by a layer of tiles adhered by an adhesive. Note the membrane may be sheet or liquid membrane drying to a sheet-like covering. Some installers use liquid membrane over sheet membrane for extra leakage risk control.

In both cases, there are two flows of water. Surface water flows along the upper surface of the floor covering, for example, tiles, then flows down a slight slope to a drain hole. In contrast, weeping water flows through the floor covering to encounter a waterproofing membrane that is contiguous with the drain hole of the floor drain. Said contiguity of membrane to drain is achieved by a mechanical clamping of the membrane to the floor drain superstructure, or by a chemical bonding of the membrane to the floor drain superstructure, or both. The floor drain is usually mounted at the lowest position in a sloped surface, although a floor drain in a flat surface is also encountered. Here note that a tray component of a linear drain refers to a four-sided floored box with one of a plurality of means of supporting a grate or tiles.

In contrast, in this Invention, an angle bar in a linear floor drain refers to a horizontal strip of metal bent ninety degrees along the length of the angle bar.

In the full mortar tiling instance, the thickness of linear floor drains, as defined by the vertical height of the total superstructure of the drain, is less of a design constraint owing to the thickness of mortar used above the membrane to form a slope. Even in full mortar, most linear floor drains perforate the membrane along the entire perimeter of the tray. Toward controlling this great increase in leak risk in comparison to the point floor drain perforation of the floor, a plurality of means of clamping the perforated membrane edges to the periphery of the linear floor drain have been elaborated, including clamping rings screwed down into a flange of the underlying tray.

In the thinset tiling method, this same style of linear drains has been adapted to attachment in the membrane-up tiling method called thinset tiling. Design constraints arise as there is so little mortar under the membrane to accommodate a tray, and above the membrane the maximum height allowable is no more than the thinnest glass tile some several millimeters in thickness. Complex membrane clamping methods become even more challenging to include. Another design challenge is the understanding that curbs and other barriers should be avoided in the quest for accessible design. In order to build drainage slopes, this forces the employment of drastic methods of lowering a portion of the wetroom subfloor at the wall, or even notching support joists to accommodate tray linear floor drains in order that they present flush to the subfloor at the wall. Not only does this involved extensive remodelling of the substructure of the floor and its supporting beam, this remodelling can compromise the structure of the building, for example, in the case of notching engineered I-beams to accommodate a linear dray tray low enough to catch surface water draining over and down tile in a barrier free bathroom where the slope of the shower catchment area begins at level with the hall floor, but the resulting theft of height from between the joists can lead to other problems such as insufficient room to accommodate the trap attached to the hub on the underside of the drain.

SUMMARY OF THE INVENTION

Accordingly, it is an object of this invention to at least partially overcome some of the disadvantages of the prior art.

The Invention, a flat shower drain as described in this Application, is a drainage fitting for the evacuation of surface and weeping water arising from showering on a tiled surface, where the tiling installation method is thinset, that is, where the tiles are adhered directly to membrane placed on top of a sloping medium such as mortar or foam installed directly to the subfloor. The height of such tile installations being minimal, a novel, minimal height flat drain assembly comprised of angle bar at the shower wall or flat bar in the midst of the flat tile floor, and said bar(s) then made contiguous with a floor drain membrane, is described.

BRIEF DESCRIPTION OF THE DRAWINGS

In the drawings, which illustrate embodiments of the invention:

FIG. 1 shows an isometric view of the shower room subfloor;

FIG. 2 shows an isometric view of a drain base being fitted to the subfloor;

FIG. 3 shows an isometric view of angle bar and flat bar;

FIG. 4 shows an isometric view angle bars fitted to the configured subfloor;

FIG. 5 shows an isometric view of sloping applied to the subfloor;

FIG. 6 shows an isometric view of membrane applied to the sloping;

FIG. 7 shows an isometric view of a drain superstructure inserted into the drain base;

FIG. 8 shows an isometric view of tiles being fitted to the floor and wall of a shower;

FIG. 9 shows an isometric view of endcaps being added to the linear drain.

FIG. 10 shows an isometric view of the underside of the shower installation.

FIG. 11 shows an isometric detail view of flat bar leading to a point drain.

DETAILED DESCRIPTION OF THE INVENTION

The Invention described in this Application is a novel drain fitting for a plurality of thinset tile shower installation types where the collecting arms of the linear drain(s) are above-membrane and range from an edge or linear drain along the wall to a diverse network of strips between tiles leading to a point drain base perforating the membrane and subfloor, further leading to a downstream sanitary drain.

An isometric view of the subfloor of a tile installation shown in FIG. 1 shows the subfloor 1 configured with a recess 5 for angle bar fitting at the edge of the subfloor 1 and with a cutaway 3 for a drain base that pierces the subfloor.

An isometric view of the same subfloor in FIG. 2 shows the fitting of the drain base 7, a backplate for wall membrane attachment 9, one of four posts 11 to support the drain superstructure to be added, flanges 13 for mounting the drain base onto the subfloor, and a fastener hole 15 through which a fastener may fasten the flanges 13 to the subfloor. A plurality of drain bases may be employed.

In FIG. 3, an isometric view of angle bar 17 shows a long lower portion for attaching membrane.

The isometric drawing in FIG. 4 shows two angle bars 17 fitted to the subfloor 1. Note the angle bars may be cut on site to fit the width of the drain install, usually between two walls, and the drain may be placed asymmetrically to avoid floor joists and services.

FIG. 5 shows an isometric view of the same installation with a sloping medium such as mortar or foam 19 adhered to the subfloor. The slope is set by building codes to encourage the flow of water toward the drain.

FIG. 6 shows an isometric view of the same installation with a waterproof membrane 21 adhered to the sloping medium.

FIG. 7 shows an isometric view of a drainage superstructure 23 with a grate 25 and hair catcher 27 inserted into the drain base in between the two angle bars attached to the drain base by a plurality of fastening methods including adhesive or a plurality of fasteners passing through complementary holes 29 drilled in the ends of the angle bars.

FIG. 8 shows an isometric view of the same shower drain installation with floor tiles 33 adhered to the floor membrane and wall tiles 31 adhered to the wall membrane. In so doing, a linear drain tray is created by the tiles and the underlying angle bar, in which both surface water and water weeping through the tiles and grout to the membrane underlying the tile and toward the drain are collected.

FIG. 9 shows an isometric view of the same shower drain installation with end caps 39 fitted to the ends of the angle bar channels, completing the sides of the drainage tray.

FIG. 10 shows the isometric view of the underside of a shower drain installation wherein the subfloor underside 41 is penetrated by a hub 43 for attachment of pipe attached by a plurality of methods and leading to a sanitary drain.

FIG. 11 shows an isometric view of a flat bar linear drain where a flat bar 43 is contiguous with membrane 45 underlying tile 47 leading to a juncture 49 between the flat bar end leading to the drain structures 51 at the wall.

In this Application, a Design is presented for a flat linear floor drain for thinset tiling, in specific, an edge drain, that is, a linear floor drain abutting a wall. Angle bar is set into a recess cut into the wall edge of the subfloor. The edge of the shower room waterproofing membrane is adhered to the horizontal upper inner surface of an angle bar placed with its outer vertex-line snugged in the line between floor and wall. Similarly, an edge of a wall membrane or equivalent tiling medium applied to a wall is continued downward and attached to the vertical inmost surface of the vertical leg of the angle bar. Alternatives include continuing the floor membrane up the wall but still adhering to interior of the L-bar and snugged to the floor-wall line, or various liquid membrane and sheet membrane combinations. In the case of the angle bar at the wall, the groove in the subfloor in which the angle bar is placed is cut into the subfloor such that the upper inner surface of the angle bar is flush with the thin end of a wedge of sloping material set on top of the subfloor, the other end of the sloping material rising by a standard value, for example, one quarter inch in twelve inches, to be achieved within the rise of 1", a representative thickness of surrounding thinset mortar or foam. This allows for a sufficiently large showering room slope to be achieved without lowering the subfloor or notching joists.

A great advantage of angle bar is that it may be cut on-site to match drainage capture basin requirements. A plurality of end caps may terminate the distal ends of the branches of a flat edge drain as described in this Application. Said end caps may be attached to the angle bar by a plurality of means. In the example of a flat edge drain, the drainage hole superstructure and drain base may be located adjacent to the wall in a position that does not interfere with underlying floor joists and other structures and services. The branches of the drain formed by angle bar may be lain atop the membrane to either side, often of different length, along the wall.

Once angle bar is laid out, thinset tile adhesive is applied to the membrane. Tile or a plurality of other continuous floor coverings is laid atop the thinset adhesive, except where angle bar is positioned. At the wall, the edge of the tile adhered halfway into angle bar along with an inner vertical wall of angle bar form the wall of a drainage tray of a linear edge drain abutting the wall. An end cap may be placed on the distal end of branches of angle bar. Said angle bar is attached to a floor point drain superstructure by a plurality of means including fasteners and adhesives. The superstructure of the point drain can be one of a plurality of designs.

The invention claimed is:

1. A flat linear floor drain assembly comprising:

an angle bar cut on-site to length; and a point floor drain mounting to a shower room subfloor contiguous at a shower room wall, wherein:

the point floor drain is mounted to the subfloor contiguous to the wall and is the point of attachment for the angle bar also contiguous to the wall, the angle bar and the point floor drain being bounded by a run of floor tiles parallel to the wall, the angle bar is set in a groove formed in the subfloor at the wall and also adhered to a floor waterproofing membrane along a largely horizontal edge of the bar, a vertical plate of the angle bar is set against the wall, and a wall membrane or a tile support medium is adhered to a vertical surface of the angle bar facing the room to effect waterproofing as well as allow for adhesion of wall tiles.

2. The drain assembly of claim 1, wherein:

the floor tiles are continued to the wall boundary, and the wall tiles hung offset from the floor surface, and the point floor drain base and the angle bar are placed beyond the shower room subfloor perimeter at a bottom of the shower room wall, such that water drains horizontally into a gap formed by the offset wall tiles, the underlying angle bars, and the edge of the floor tiles reaching under an outer plane of the wall.

3. The drain assembly of claim 1, wherein:

a flat bar laid down a sloping mortar or foam and sealed to the mortar with a liquid membrane, and one end of the flat bar ending in the point drain, with the membrane attached along opposing lengths of the flat bar, offering a waterproof course for surface and weeping water flow to the point drain at the wall between two parallel rows of overlying tiles spaced at a distance defined by the flat bar.

* * * * *